US005876138A

United States Patent [19]

Gueret

[11] Patent Number: 5,876,138

[45] Date of Patent: Mar. 2, 1999

[54] COSMETIC APPLICATOR

[75] Inventor: Jean-Louis Gueret, Paris, France

[73] Assignee: L'Oreal, Paris, France

[21] Appl. No.: 606,280

[22] Filed: Feb. 23, 1996

[30] Foreign Application Priority Data

Feb. 23, 1995 [FR] France ..... 95 02101

[51] Int. Cl.[6] ..... A45D 40/00; A46B 11/00

[52] U.S. Cl. ..... 401/129; 132/218; 401/122

[58] Field of Search ..... 401/122, 129; 132/218; 15/206

[56] References Cited

U.S. PATENT DOCUMENTS

| | | | |
|---|---|---|---|
| 3,084,374 | 4/1963 | Ziegler . | |
| 3,469,928 | 9/1969 | Widegren . | |
| 3,908,675 | 9/1975 | Spatz et al. | 401/122 X |
| 4,175,574 | 11/1979 | Zulberti | 401/122 |
| 4,527,575 | 7/1985 | Vasas | 401/122 X |
| 5,022,559 | 6/1991 | Condon | 401/122 X |

FOREIGN PATENT DOCUMENTS

| | | | |
|---|---|---|---|
| 161980 | 11/1985 | European Pat. Off. | 401/122 |
| 3327405 | 2/1985 | Germany | 401/122 |
| 3542474 C1 | 5/1987 | Germany . | |
| 303939 | 1/1929 | United Kingdom | 15/206 |
| 2170996 | 8/1986 | United Kingdom | 401/122 |

*Primary Examiner*—Steven A. Bratlie
*Attorney, Agent, or Firm*—Oliff & Berridge, PLC

[57] ABSTRACT

A cosmetic applicator such as a mascara applicator is provided including a container for the cosmetic. The container includes a constriction at its upper part, forming a wiper, and a cap fitted with a rod having at its end a brush which dips into the container as it passes through the constriction. The rod has, above the brush, an elastically deformable cleaning element whose diameter is at least substantially equal to the diameter of the constriction. The portion of the rod located between the cleaning element and the brush allows the pressures prevailing inside and outside the container to be substantially balanced before the brush engages the constriction when it is withdrawn.

12 Claims, 4 Drawing Sheets

COSMETIC APPLICATOR

BACKGROUND OF THE INVENTION

The present invention relates to a cosmetic applicator that can be used in particular to apply mascara.

Applicators of this type are already known and comprise a container designed to contain the cosmetic and fitted at the upper part with a constriction (or wiper) and with a cap having a rod provided at its end with a brush which dips into the cosmetic when the cap is placed on the container. Extraction of the brush after unscrewing of the cap causes the cosmetic to be wiped by the brush passing through the constriction.

Such applicators, which allow the quantity of cosmetic extracted by the brush to be determined, have the disadvantage that, as the cosmetic is used up, it builds up as it dries in the part of the container located above the constriction. This gradually causes the brush passageway to clog and some of the cosmetic to be wasted.

Known applicators have in general the disadvantage that, when the brush is extracted, the rod holding it produces a piston effect, creating a negative pressure inside the container which interferes with the wiping of the brush as it passes through the constriction.

SUMMARY OF THE INVENTION

The present invention has the objective of avoiding the aforementioned drawbacks by a simple, reliable and inexpensive means.

The present invention relates to a cosmetic applicator, such as a mascara applicator of the type having a container for the cosmetic. The container includes at its upper part a constriction forming a wiper, and a cap fitted with a rod having at its end a brush that dips into the container as it passes through the constriction when the cap is placed on the container. The rod has, above the brush, an elastically deformable cleaning element whose diameter is at least substantially equal to the diameter of the constriction. The portion of the rod located between the cleaning element and the brush allows the pressures prevailing inside and outside the container to be substantially balanced before the brush engages the constriction when it is withdrawn.

This balancing of internal and external pressures can be accomplished in different ways. For example, the diameter of the rod could be made smaller than that of the constriction over a sufficient length between the brush and the cleaning element. A cleaning element provided with openings that does not bring about a seal when it passes through the constriction can also be used.

The balancing of internal and external pressures is thus obtained by the fact that, before the brush passes through the constriction, an opening is produced through which ambient air can enter the lower body of the container to occupy the volume left free by extracting of the rod. This balancing can also be accomplished by the fact that a certain quantity of cosmetic is sucked back inside the container by the negative pressure resulting from withdrawal of the cap rod.

According to the present invention, the cleaning element comprises a thin brush or a flexible diaphragm made of a readily deformable material. According to one embodiment of the invention, the brush has a diameter substantially greater than the diameter of the constriction. According to the invention, the body of the brush can have an external geometry of various shapes, for example cylindrical, frustroconical, double-frustro conical, or with a rounded shape whose diameter decreases at both its ends.

The tufts of bristles comprising the brush can be disposed regularly on the periphery thereof or in lines parallel to the brush axis or in helical lines. Further, the brush can be made in any manner and with materials of any appropriate nature.

According to the present invention, the cleaning element is at a sufficient distance from the brush so that when the brush passes through the constriction. The cleaning element can deform downward without pressing substantially on the brush, which would likely interfere with the wiping action.

According to one embodiment of the present invention, the brush is continuous with the cleaning element, which itself is in the form of a brush. Thus, the brush and cleaning element assembly have the shape of a fish, the width of whose tail is preferably distinctly greater than the diameter of the constriction, and the width of whose body is also distinctly greater than the diameter of the constriction and whose part connecting the head to the tail is distinctly smaller in width than the diameter of the constriction in order to balance the internal and external pressures when the brush is removed from the container during use.

Because of this pressure balancing, the applicator according to the present invention has the advantage of allowing precise wiping of the brush when it is extracted from the container. This allows the user good control of the quantity of cosmetic entrained by the brush, which quantity can be determined as a function of the use to be made thereof.

The applicator according to the invention also has the advantage of preventing cosmetic from building up in the part of the container located above the constriction, when the brush is reintroduced inside the container, at which location it would thicken and harden, gradually impeding passage of the brush. Indeed, when the brush is introduced into the container, passage of the brush through the constriction causes further wiping of the brush, which has the effect of depositing a certain quantity of cosmetic composition above the constriction.

As the downward motion of the brush inside the container continues, the cleaning element which, according to the present invention, is above the brush and whose diameter is preferably slightly greater than the diameter of the part of the container located immediately above the constriction, carries along the cosmetic that is deposited above the constriction when the brush passes through. As a result, the cleaning element carries this cosmetic with it through the constriction, thus bringing it inside the container.

The location of the cleaning element at a distance above the brush has the additional utility of being able to better entrain the cosmetic once the latter has been deposited above the constriction. The invention allows the part of the container located above the constriction to be kept constantly clean without buildup of cosmetic that begins to harden or clog. Further, having the cleaning element continuous with the brush directly at the end of the rod which, in the closed state, penetrates the constriction to block it, has the advantage of contributing to preventing the thickened cosmetic from building up on the applicator.

BRIEF DESCRIPTION OF THE DRAWINGS

For better understanding of the invention, several embodiments taken as examples will now be described for illustration and without limitation with reference to the attached drawing wherein.

Figure 3:
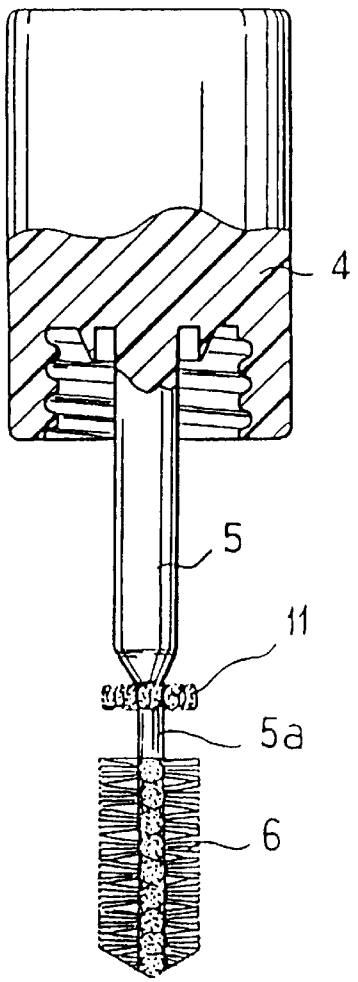
FIGS. 2 and 3 show two embodiments of the applicator according to the invention in schematic cross section.

This applicator has a container 1, which inside its neck has a capsule 2 made of, for example, plastic which blocks the neck, leaving an opening 3 forming a constriction and defining a certain free space in the neck from the upper part of container 1. Opening or constriction 3 is also called a wiper.

A cap 4 is provided with a rod 5 that, at its lower part, has a brush 6 whose function is to extract a certain quantity of cosmetic with a view to application. For sealed closure, cap 4 is provided with a thread 7 which cooperates with a thread 8 located at the upper part of container 1. In the closed state, brush 6 dips into cosmetic composition 9, and cap 4 is screwed onto container 1.

To apply the cosmetic, cap 4 is unscrewed and brush 6 withdrawn by passing it through constriction 3. This causes the surplus cosmetic that the brush would hold by capillary action outside container 1, to drop back into the inside of container 1. However, movement of the rod inside the constriction before the brush has penetrated the latter results in negative pressure being created inside the container relative to atmosphere, which creates a piston effect and interferes with dispensing of cosmetic when the brush passes through the constriction.

After use, the bottle is reclosed by introducing brush 6 thorough constriction 3, which causes further wiping of the brush and causes a certain quantity of cosmetic composition 10 to be deposited into the space of the container located above constriction 3. This cosmetic, already exposed to air during application, is generally more viscous than the cosmetic 9 inside the bottle, so that during successive applications, the quantity of cosmetic 10 building up above constriction 3 becomes greater and greater and eventually solidifies, blocking passage of brush 6. This has the dual disadvantage of interfering with wiping of the brush and thus modifying the quantity of cosmetic held by the brush with a view to application, and also of causing a quantity of cosmetic building up in 10 to be wasted. By a simple, effective, and economical means, the present invention eliminates the above-listed disadvantages.

DETAILED DESCRIPTION OF PREFERRED EMBODIMENTS

Figure 2:
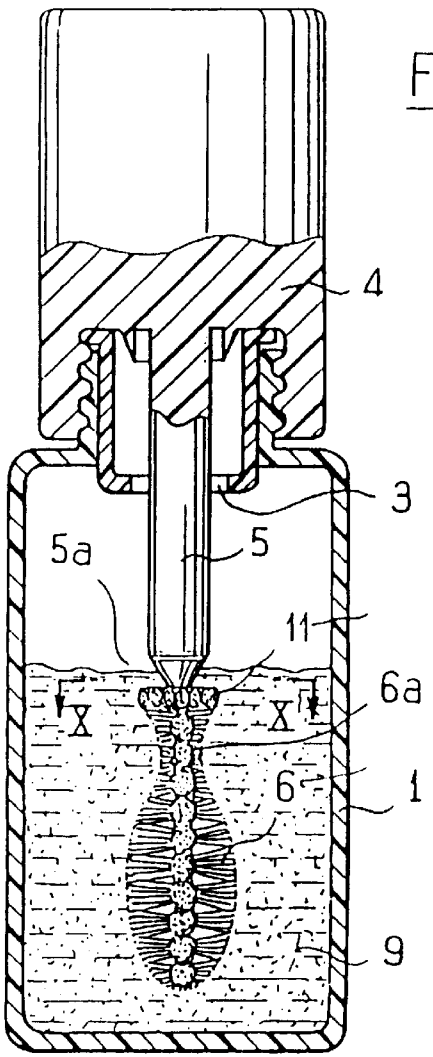
Figure 1:
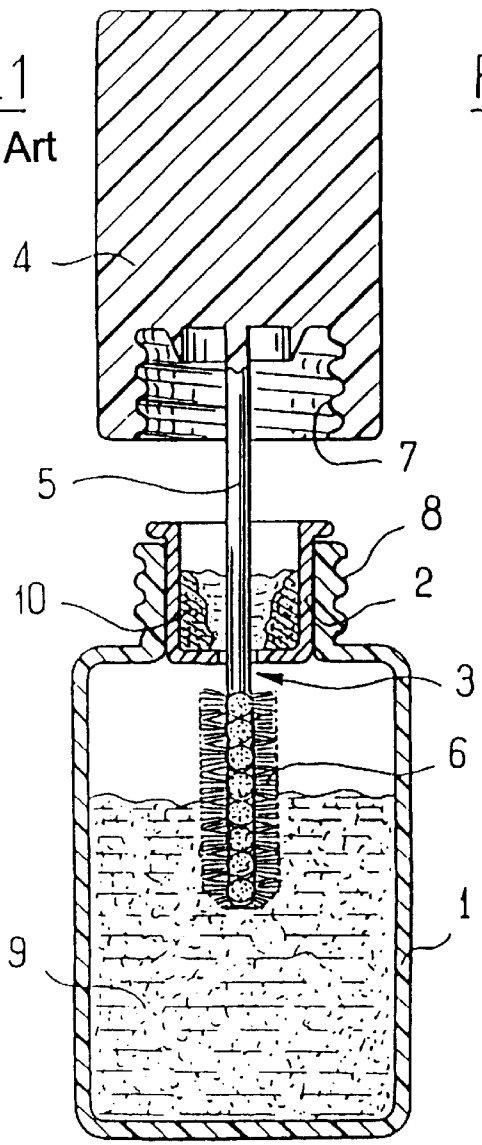
FIG. 1 Prior Art
FIG. 1 is a schematic view in cross section of a cosmetic applicator according to the prior art.

FIGS. 2 and 3, which show two particular embodiments of the invention, show how cleaning element 11 is disposed above brush 6.

According to the invention, the diameter of cleaning element 11 is wide enough to sweep up the cosmetic deposited above the constriction and return it to container 1.

In an embodiment of FIG. 2, the brush has the general shape of a fish whose body 6 connects to cleaning element 11 which constitutes its tail.

According to the invention, part 6*a* of brush 6 which connects it to cleaning element 11 has a smaller diameter than that of constriction 3. When part 6*a* passes through constriction 3, atmospheric pressure can be reestablished inside container 1 before the body of brush 6 itself engages constriction 3.

In the embodiment of FIG. 3, brush 6 has a cylindrical shape with a frustroconical end, with cleaning element 11 being located on rod 5a slightly above the brush. This second embodiment of the invention is distinguished from that of FIG. 2 by a discontinuity between brush 6 and cleaning element 11. This configuration also allows container 1 to communicate with the atmosphere and the piston effect, normally occurring when the applicator is removed from the container, to be broken.

The fact that cleaning element 11 is separated from the body of brush 6 by an empty space, or one with a smaller diameter, also has the advantage that when it rises, cleaning element 11 can easily deform downward without substantially deforming the upper part of the brush and without interfering with wiping of the brush when it passes into constriction 3.

Figure 4:
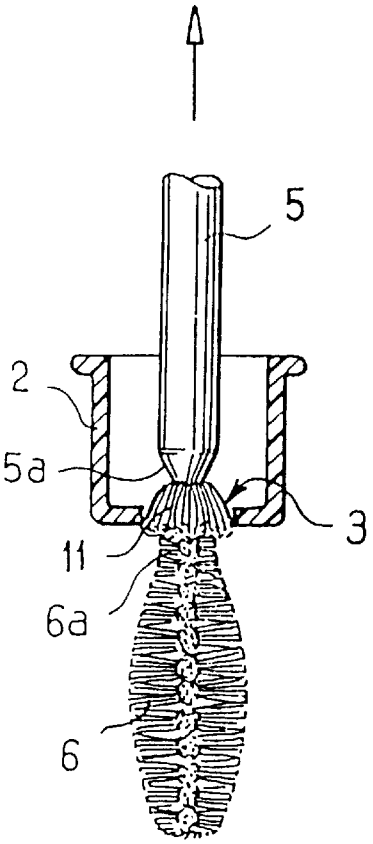
FIG. 4 shows schematically the deformation of the cleaning element according to the invention when the brush is withdrawn from the container.

FIG. 4 schematically shows the extraction of the applicator of FIG. 2 from the container at the time cleaning element 11 passes through constriction 3 while its periphery is folded downward. This deformation of cleaning element 11 causes no deformation of brush 6 by reason of space 6 left open between cleaning element 11 and the body of brush 6. When cleaning element 11 is wiped, a substantial part of the cosmetic it is holding is removed without interfering with the controlled wiping of brush 6. This allows only a predetermined quantity of cosmetic composition to be held by the brush.

Figure 7:
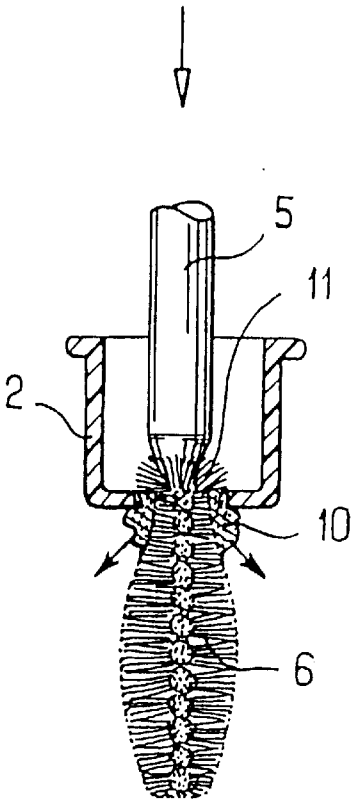
FIGS. 5 to 7 show schematically the deformation of the brush and of the cleaning element according to the invention when the brush is introduced into the container.
Figure 6:
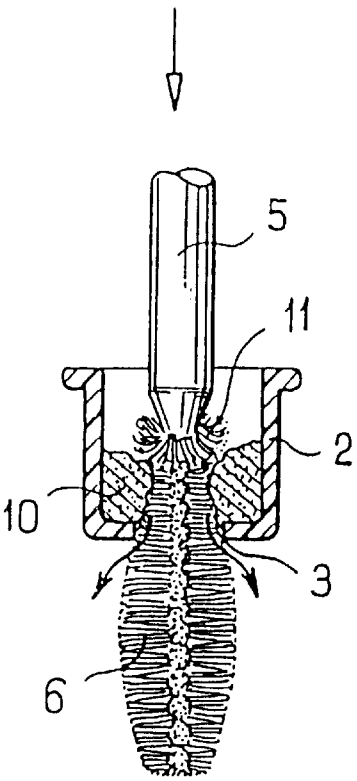
Figure 5:
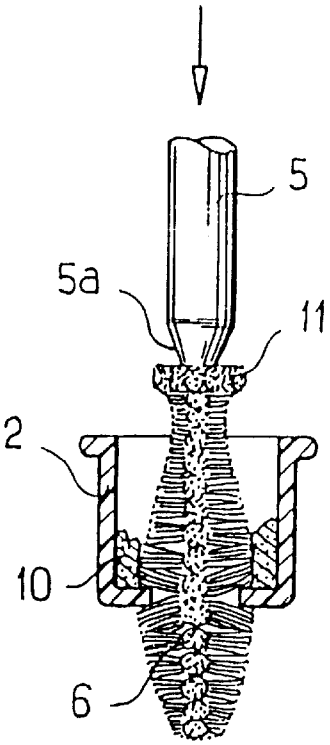

FIG. 5 shows brush 6 while it is being reinserted into container 1 and being slightly deformed by its passage through constriction 3. This passage causes wiping of the brush which deposits some of the unused cosmetic composition at 10 above constriction 3. As the brush continues to move down the container, it can be seen, as shown in FIG. 6, that the periphery of cleaning element 11 sweeps the internal surface of capsule 2 carrying downward most of the cosmetic composition 10 that built up there when the brush passed. This cosmetic 10 is easily released into container 1, as shown by the arrows, due to the free space 6a between the body of brush 6 and cleaning element 11. FIG. 7 shows how, when cleaning element 11 arrives at constriction 3, it deforms upward, completing reintroduction into the container of the cosmetic that had built up above the constriction.

In a preferred embodiment, lower part 5*a* of rod 5 has, as can be seen in FIGS. 2, 4, and 5, a tapered shape allowing easier passage of cleaning element 11 through constriction 3. Addition of cleaning element 11 above the brush also has the effect of avoiding any buildup of cosmetic composition above the constriction, eliminating the disadvantages referred to above for the known applicators of the prior art.

Figure 9:
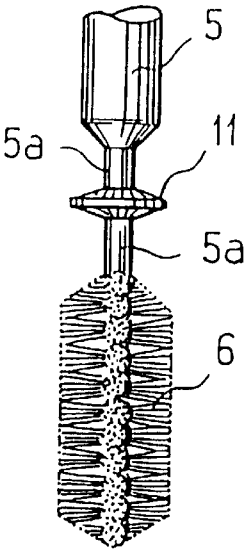
FIGS. 8 and 9 show variants of the brush and the cleaning element according to the invention.
Figure 8:
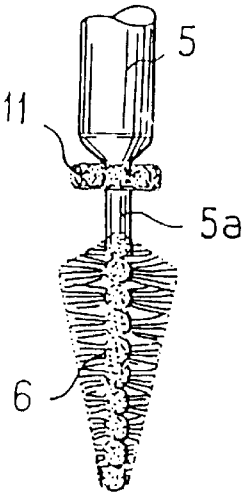

FIG. 8 shows another embodiment of the brush which has a frustroconical shape. In the embodiment of FIG. 9, brush 6 has a generally cylindrical shape and cleaning element 11 comprises a thin diaphragm whose central part is integral with extension 5*a* of rod 5. The periphery deforms elastically when applied to the internal wall of capsule 2 above constriction 3 and then passes through constriction 3 itself.

Diaphragm 11 could be provided with orifices to facilitate balancing of the internal and external pressures.

Figure 11:
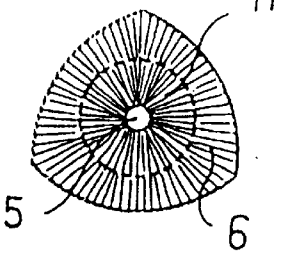
FIGS. 10 to 13 show cross sections through the brush according to several embodiments.
Figure 10:
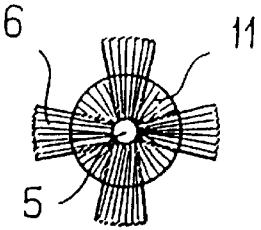

FIG. 10 is a sectional view along line X—X in FIG. 2. Cleaning element 11 comprises a thin, circular brush as well as brush 6 which, in the present case, comprises four rows of bristle tufts disposed at right angles. In the embodiment of FIG. 11, brush 6 has tufts distributed regularly over its periphery, which has a prism-shaped cross section, with a curved triangular base. Cleaning element 11 has a circular form.

Figure 13:
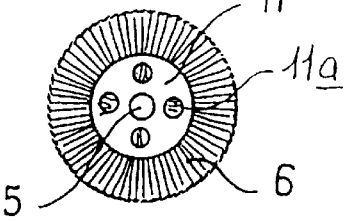
Figure 12:
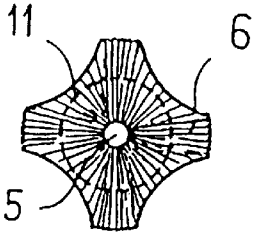
Figure 14:
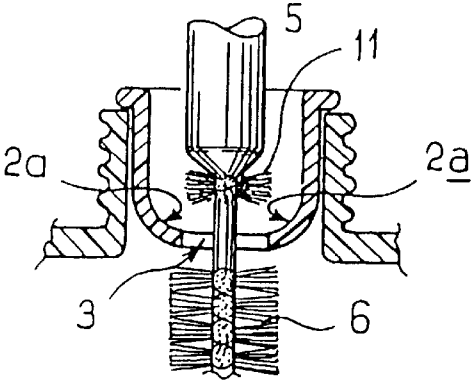
FIG. 14 shows a schematic cross section of a variant of the constriction according to the invention.

In the embodiment of FIG. 12, cleaning element 11 has a circular periphery and the section of brush 6 has the general shape of a square with cut-off corners and concave sides. FIG. 13 shows a cylindrical-shaped brush and a cleaning element 11, like that shown in FIG. 9, which compresses an easily deformable diaphragm made of an elastic material and having four perforations 11a. Finally, FIG. 14 shows a variant in which the shape of upper part 2*a* of constriction 3 has been modified according to a preferred embodiment of the invention in order to gradually reduce the inside diameter of capsule 2 to facilitate removal through constriction 3 of the cosmetic composition that has built up above it.

Figure 15:
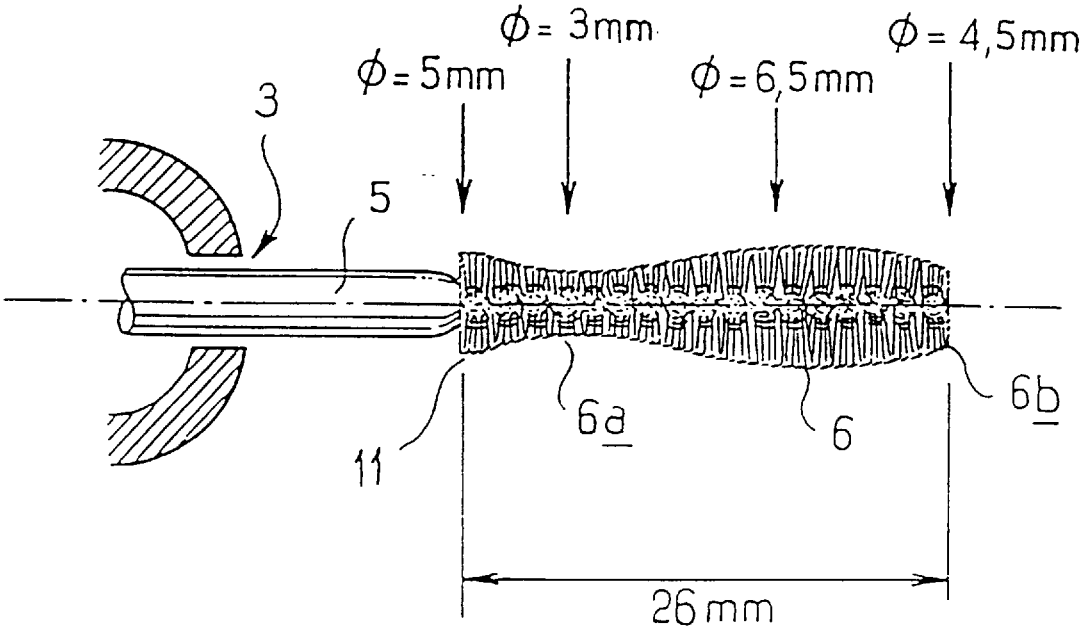
FIG. 15 shows a preferred embodiment of the end of the rod, and of the brush of the applicator, according to the invention.

FIG. 15 shows, in actual proportions, a preferred embodiment of the invention. In this embodiment, constriction 3 has a diameter of 3.8 mm and rod 5 has a diameter of 3.5 mm. Cleaning element 11, which has a diameter of 5 mm, forms a single unit with the brush with which it connects by part 6*a*, which is 3 mm in diameter. Brush 6 has the general shape of a shuttle with a maximum diameter of 6 mm and a diameter of 4.5 mm at its front end 6*b*. The total length of brush 6 and cleaning element 11 is 26 mm.

It can be seen that, according to the invention, by a simple and economical means, both the piston effect that interferes with wiping of the brush and the buildup of cosmetic composition above the constriction are avoided.

Of course the embodiments described above are not limiting and can receive any desirable modifications without thereby departing from the framework of the invention.

In particular, it is clear that the invention is not limited to a particular brush shape and that the brush can be made with bristle tufts disposed along its generatrices or in a helical path around rod 5, and the brush can also be made with bristles regularly distributed over the totality of its periphery.

It also goes without saying that the brush can be made in different ways and with materials of different kinds.

It is also clear that the cleaning element can be made other than in the form of a flat brush having tufts disposed over its periphery or bristles distributed regularly or in the form of a flexible diaphragm.

Indeed, it is sufficient for the cleaning element to be sufficiently deformable to sweep the cosmetic composition above the constriction and cause it to pass through the latter.

What is claimed is:

1. A cosmetic applicator, such as a mascara applicator, comprising:

a container for the cosmetic including an upper part and a constriction with a first diameter forming a wiper disposed at said upper part; and a cap fitted with a rod having an end and a brush, said brush having a body for receiving and applying the cosmetic, said brush disposed at said end that dips into said container as it passes through said constriction when said container is closed, a first portion of the rod adjacent to said cap having a second diameter, said rod including:

an elastically deformable cleaning element disposed above said body of the brush and having a diameter at least substantially equal to said first diameter of said constriction;

a second portion of the rod having a diameter that is less than the first diameter and that is equal to or less than said second diameter, said second portion being located between said cleaning element and said body of the brush to space said cleaning element from said body of the brush;

wherein said second portion and the cleaning element are positioned to allow pressures prevailing inside and outside said container to be substantially balanced before said body of the brush engages said constriction when it is withdrawn.

2. The applicator according to claim 1, wherein said cleaning element comprises a brush.

3. The applicator according to claim 1, wherein said cleaning element comprises a flexible diaphragm made of an easily deformable material.

4. The applicator according to claim 3, wherein said flexible diaphragm includes at least one perforation.

5. The applicator according to claim 1, wherein said body of the brush has a substantially greater diameter than said diameter of said constriction.

6. The applicator according to claim 1, wherein said cleaning element is positioned a sufficient distance above said body of the brush to deform downward when passing through said constriction.

7. The applicator according to claim 1, wherein said body of the brush has a shape selected from the group consisting of a cylindrical, frustroconical, double-frustroconical and a rounded profile that tapers at both ends.

8. The applicator according to claim 1, wherein said body of the brush and said cleaning element are integral and include a tail portion having a width greater than said diameter of said constriction, a head portion having a diameter greater than said diameter of said constriction and a connecting portion disposed between said head portion and said tail portion having a diameter smaller than said diameter of said constriction.

9. The applicator according to claim 1, wherein said body of the brush comprises a periphery, an axis and tufts of bristles disposed at said periphery in lines parallel to said axis.

10. The applicator according to claim 1, wherein said body of the brush comprises a periphery, an axis and tufts of bristles disposed at said periphery in helical lines.

11. The applicator according to claim 1, further comprising a capsule inserted in said upper portion of said container.

12. The applicator according to claim 11, wherein said capsule is disposed above said constriction and has an inside diameter that tapers until it is equal to said diameter of said constriction.

* * * * *